US006315030B1

(12) United States Patent
Poloni et al.

(10) Patent No.: US 6,315,030 B1
(45) Date of Patent: Nov. 13, 2001

(54) HIGH SPEED CONTINUOUS CASTING DEVICE AND RELATIVE METHOD

(75) Inventors: Alfredo Poloni, Fogliano di Redipuglia; Milorad Pavlicevic, Udine, both of (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/479,942

(22) Filed: Jan. 10, 2000

(30) Foreign Application Priority Data

Jan. 13, 1999 (IT) ..... UD99A0002

(51) Int. Cl.[7] ..... B22D 11/124
(52) U.S. Cl. ..... 164/485; 164/441; 164/443
(58) Field of Search ..... 164/418, 459, 164/443, 485, 348, 441, 442

(56) References Cited

U.S. PATENT DOCUMENTS

| | | | | |
|---|---|---|---|---|
| 3,559,719 | * | 2/1971 | Rossi | 164/273 |
| 3,603,377 | * | 9/1971 | Khimich et al. | 164/282 |
| 3,763,920 | | 10/1973 | Auman et al. . | |
| 4,669,529 | | 6/1987 | Evertz . | |
| 5,207,266 | | 5/1993 | Nakashima et al. . | |
| 5,460,220 | * | 10/1995 | Coassin | 164/483 |
| 5,601,138 | * | 2/1997 | Di Giusto et al. | 164/452 |
| 6,129,137 | * | 10/2000 | Pleschiutschnigg | 164/476 |

FOREIGN PATENT DOCUMENTS

| | | | |
|---|---|---|---|
| 2409820 | | 9/1975 | (DE) . |
| 0686445 | | 12/1995 | (EP) . |
| 0686446 | | 12/1995 | (EP) . |
| 0807477 | | 12/1997 | (EP) . |
| 0807478 | | 12/1997 | (EP) . |
| 0846508 | | 6/1998 | (EP) . |
| 0 909 597-A1 | * | 4/1999 | (EP) . |

OTHER PUBLICATIONS

Gottardi, R., et al, "Net and Near Net Shape Continuous Casting: Developments in Thin Slab Casting" Steel Times—Incorporating Iron & Steel, vol. 220, No. 11, Nov. 1, 1992, pp. 524–525.

* cited by examiner

*Primary Examiner*—Tom Dunn
*Assistant Examiner*—Len Tran

(57) ABSTRACT

High speed continuous casting device and method, comprising an ingot mold provided with a crystalliser having side-walls between which the product as it cools is suitable to take shape, the product then being sent to a guide, containing and possibly pre-rolling assembly located downstream of the ingot mold and cooperating with secondary cooling, and a system of primary cooling associated with the side-walls, the crystalliser having a longitudinal development with a radius of curvature ("R") having a value at least five times more than the first radius of curvature of the product in the secondary cooling zone located at the outlet of the crystalliser, wherein the length (L) of the walls is more than 1050 mm, so that a progressive and gradual deformation of the product being formed is obtained which prevents tensions, inner cracks and surface lesions from forming thereon.

29 Claims, 4 Drawing Sheets

HIGH SPEED CONTINUOUS CASTING DEVICE AND RELATIVE METHOD

FIELD OF THE INVENTION

This invention concerns a high speed continuous casting device and the relative continuous casting method, as set forth in the respective main claims.

The invention is used in the field of steel production to cast billets or blooms of any type or section. In the following description we shall refer, for simplicity of exposition, to the application of the invention for producing billets, but the invention can be applied to other types of products too.

BACKGROUND OF THE INVENTION

In continuous casting the attainment of high casting speeds and hence an ever greater productivity, while both the surface quality and the inner quality of the product is maintained high, is correlated to the optimisation of a plurality of technological parameters concerning the characteristics of the crystalliser and the equipment connected thereto, and also the casting procedure.

These parameters concern the geometrical and dimensional characteristics of the crystalliser, the cooling system, the system to lubricate the inner walls and the processes to which the product being formed is subjected.

In conventional continuous casting plants, the problems connected with the high temperatures reached by the walls of the crystalliser condition the choice of the parameters decisively, considerably limiting the casting speeds which can be obtained because of the deformations of the crystalliser and the reduction of the mechanical properties of the copper at high temperatures.

To be more exact, the lack of uniformity in temperature along the walls of the crystalliser causes a non-uniform deformation of the walls, due to the thermal expansion of the material, and therefore problems concerned with the surface defects which this deformation causes on the product being formed.

Moreover, as it goes down the crystalliser, the skin of the product being formed tends to shrink as it solidifies.

This causes the skin to become detached from the wall of the crystalliser, which enormously reduces the heat exchange between the product and the crystalliser, to such an extent that the cooling, and thus the solidification of the skin, is practically blocked, which causes the skin to re-melt.

Cracks are created in the skin which, when the cast product is removed, may propagate and cause the product to break, and consequently the liquid metal inside the product can leak out (the break-out phenomenon).

In the case of a product with a square, rectangular or generally polygonal section, another problem is that the corners are subjected to a more intense cooling since they are subjected to simultaneous cooling on several sides of the crystalliser.

In correspondence with the corners, the skin forms more quickly and the consequent shrinkage of the material causes the product being formed to become detached from the wall of the crystalliser very quickly, thus interrupting the cooling and solidification process, and therefore making the temperature of the solidified part increase drastically.

For this reason, in correspondence with the corners, the skin of the product being formed has a lesser thickness than on its plane faces and differences of temperature are created between the edges and the plane faces of the product.

These differences generate tensions which lead to the formation of cracks and other surface defects, which lower the quality of the product and can also cause the skin to break and the liquid steel to break out.

In continuous casting plants used at present, it has been impossible to find a satisfactory solution to all these problems, and furthermore the attempt to solve some of them has led to an accentuation of others.

So, for example, the attempt to increase the casting speed has led to an unsatisfactory cooling of the product being formed, and therefore the solidification of an insufficient thickness of skin, with consequent problems in the removal and pre-rolling of the product emerging from the crystalliser.

On the other hand, any attempt to obtain an optimum cooling of the product has led to a reduction in the casting speed and therefore a reduction in productivity.

Moreover, adapting the conformation of the crystalliser to the shrinkage of the skin of the product being formed in every longitudinal zone of the crystalliser, with the purpose of guaranteeing maximum efficiency of heat exchange, has led to problems of friction between the walls of the crystalliser and the product being formed, and therefore the lowering of the surface quality of the product.

The present Applicant has devised, tested and embodied this invention to overcome the shortcomings of the state of the art and to obtain further advantages, such as in particular a tangible increase in the casting speed.

SUMMARY OF THE INVENTION

The invention is set forth and characterised in the respective main claims, while the dependent claims describe other characteristics of the invention.

One of the purposes of the invention is to achieve a continuous casting device, and to perfect a relative method, which will allow to achieve high casting speeds, and hence high productivity of the plant, without compromising either the surface or inner quality of the product obtained.

Another purpose of the invention is to achieve a continuous casting device with a crystalliser subject to limited deformation, which will allow to limit the shrinkage and deformation of the skin of the billet being formed.

Another purpose of the invention is to achieve a continuous casting device wherein the crystalliser has an inner taper adapted to the casting speeds and to the type of steel which is to be cast, and wherein the position of the meniscus can be modified according to the casting parameters.

A further purpose of the invention is to achieve a continuous casting device suitable to be inserted in a casting line which can be directly associated with shearing, heating and rolling devices of a conventional type.

The continuous casting device according to the invention comprises a crystalliser characterised by dimensional and technological characteristics which allow to obtain a tangible increase in the casting speed, both with plate crystallisers and with crystallisers of the tubular type.

According to one characteristic of the invention, the crystalliser has a longitudinal development with a length of between 1050 and 1500 mm.

In the past, in the first continuous casting machines, crystallisers of 2500 mm in length were provided.

However, since such crystallisers did not have an inner taper such as to adapt to the progressive shrinkage of the product during solidification, this length was not exploited and the crystalliser, in its lower part, acted as a heat barrier between the solidified thickness of skin, which tended to become progressively detached from the wall, and the cooling system.

In a preferential embodiment, the crystalliser has an at least partly curved longitudinal development, so as to allow an efficacious in-line continuity with the removal and straightening means located downstream, at the same time allowing the bulk of the casting device to be contained in height.

The radius of curvature of the crystalliser is correlated to the radius of curvature of the guide equipment and the optional pre-rolling and straightening equipment located in the secondary cooling zone defined downstream therefrom.

In this way, already inside the crystalliser a progressive and gradual deformation of the billet is induced when it is solidifying, preventing the generation of critical tensions which create internal discontinuity (cracks) in the product being formed.

The crystalliser of the continuous casting device according to the invention is also associated with a high performance primary cooling system which achieves a high heat exchange thanks to the speed of circulation of the cooling fluid and the geometry and surface configuration of the channels wherein the cooling liquid circulates.

The cooling system also allows to maintain the walls of the crystalliser at relatively low average temperatures, considerably limiting the deformation thereof and therefore the negative effects which this deformation entails on the skin of the product being formed.

According to another characteristic of the invention, the crystalliser has a transverse section geometry suitable to confer a considerable structural rigidity on the walls.

Inside, the crystalliser also has a downward tapering development, the geometry of which is correlated to the entity of the shrinkage of the product being formed; in this way the detachment of the skin of the cast product from the walls of the crystalliser is limited to a minimum, with considerable advantages in terms of maintaining a constant heat exchange with the product.

According to one characteristic of the invention, the cooling in the corners of the crystalliser is controlled in a differentiated manner with respect to the plane zones. This allows to condition the shrinkage of the cast product in correspondence with the corners in an appropriate manner, since this shrinkage is quicker than in the plane zones as the cooling acts simultaneously on both sides of the corner.

The invention provides to use lubrication means between the inner surface of the walls of the crystalliser and the skin of the product being formed, in order to reduce friction and avoid sticking, which improves the conditions of heat exchange and prevents the deterioration of the surface quality of the cast product.

In a possible variant, the invention provides means suitable to generate a pulsing electromagnetic field; the liquid steel is subjected to the action of this field so as to improve the inner quality of the product being formed in terms of homogeneity and compactness, at the same time encouraging the cooling process.

Therefore, with this invention, we obtain a considerable improvement in the conditions of cooling and solidification of the product being formed, which allow to achieve a greater casting speed without compromising the quality of the product being formed.

BRIEF DESCRIPTION OF THE DRAWINGS

These and other characteristics of the invention will become clear from the following description of some preferential forms of embodiment, given as a non-restrictive example, with reference to the attached drawings wherein.

DETAILED DESCRIPTION OF PREFERRED EMBODIMENTS

Figure 1:
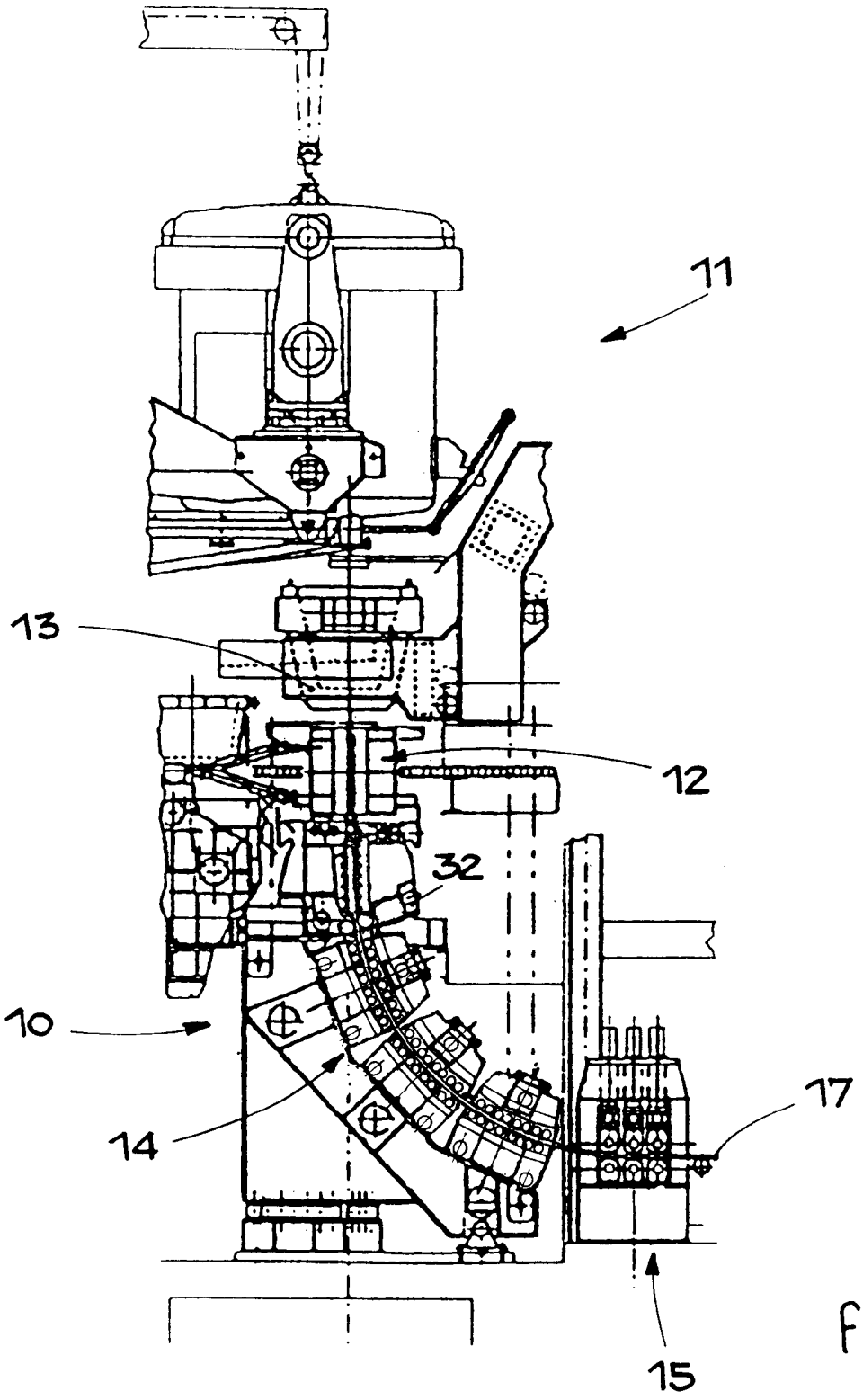
FIG. 1 is a side view of a continuous casting plant comprising a device according to the invention.

With reference to FIG. 1, the reference number 10 denotes in its entirety a continuous casting device according to the invention inserted in a casting plant 11 of a known type and therefore not described in any detail here.

The continuous casting device 10 comprises an ingot mold 12 provided with a crystalliser 16 and arranged below a tundish 13, which is equipped with a nozzle 13*a* by means of which the liquid steel is introduced into the crystalliser 16.

The ingot mold 12 is associated underneath with a guide, containing and possibly pre-rolling assembly 14, which has a curved development and cooperates in a known manner with secondary cooling means 32.

By means of this assembly 14, the product in formation 17, which in this example is a billet, is progressively removed from the crystalliser 16, cooled, possibly subjected to a first soft reduction in section and taken onto a substantially horizontal plane.

Downstream of the assembly 14 there is a removal and straightening assembly 15, cooperating in a known manner with shearing means which are not shown here.

The crystalliser 16, which can be of the tubular type (FIGS. 3, 5*a* and 5*b*) or the plate type 116 (FIG. 4), is provided with a wall 16*a* cooperating with a primary cooling system 18, so as to achieve a heat exchange with the billet 17 being formed.

The heat exchange is suitable to cause a defined thickness of skin 17*a* to solidify over the entire perimeter of the billet 17.

According to one characteristic of the invention, the crystalliser 16 has an overall length "L", between 1050 and 1500 mm.

Figure 2:
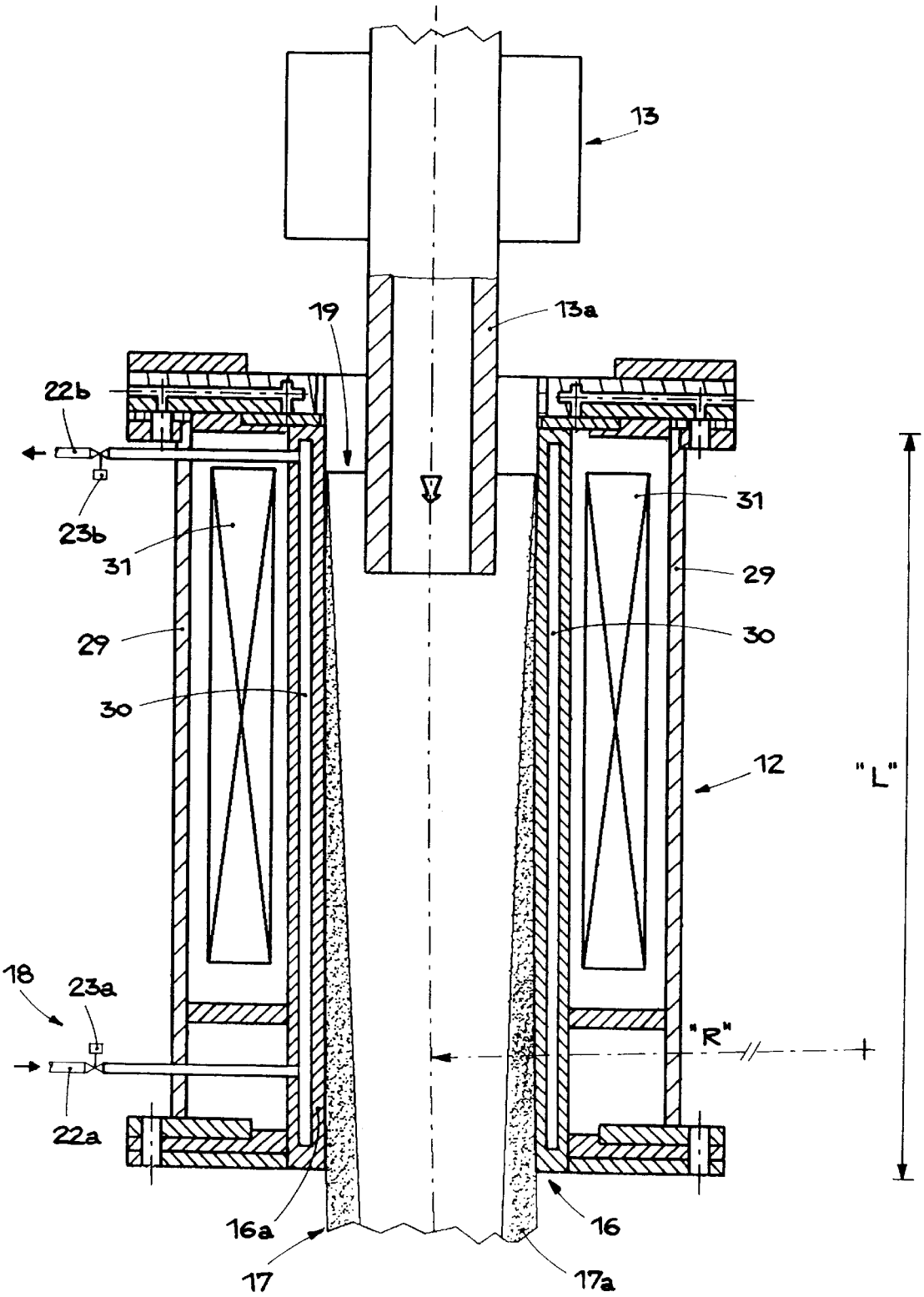
FIG. 2 is a longitudinal section of the ingot mold of a continuous casting device according to the invention.

In the embodiment shown in FIG. 2, the crystalliser 16 has a slightly curved longitudinal development, which in this case is only in the lower part, so that it properly connects with the guide and containing assembly 14 included downstream.

The radius of curvature "R" of the lower, curved segment of the crystalliser 16 has a value which is advantageously at least up to five times greater than the value of the first radius of curvature of the product 17 in the secondary cooling zone at the outlet of the crystalliser 16, and assumes a preferential value of around 70 m, yet can vary in any case at least within an interval of between 60 and 85 m.

The curvature of the terminal segment of the crystalliser 16 must be such that it does not overly stress the forming billet 17, which is still in a partly solidified state only and still has a very fragile and deformable skin; at the same time, the curvature must allow an efficient connection with the curved segment located immediately downstream, where the billet 17 is straightened.

The curved segment downstream must respect the contrasting requirements of not stressing the billet 17 too much and having the maximum technologically compatible curvature in order to reduce the overall height of the casting plant 11.

These sufficiently wide values of the radius of curvature "R" of the lower segment of the crystalliser 16 also allow a more uniform distribution of the liquid steel inside the crystalliser 16, an improvement in the conditions of cooling and solidification of the billet 17 and a better deformation of the solidified skin during the cycles of mechanical oscillation.

According to a variant, the radius R assumes an infinite value and the crystalliser 16 has a vertical longitudinal development.

Inside, the crystalliser 16 has a downward tapering development, and a taper value correlated to the entity of the shrinkage of the billet 17 being formed.

In other words, the transit channel defined by the walls of the crystalliser 16 tends to shrink slightly as it goes from the zone of the meniscus 19 to the outlet zone of the crystalliser 16, in order to adapt to the progressive shrinkage of the billet 17 as the latter gradually cools along the crystalliser 16.

The inner taper of the crystalliser 16 may be of the continuous type, for example with a parabolic development, or also of the discontinuous or segmented type (multi-tapered) with the taper variable in steps from one longitudinal segment to the subsequent one; the inclinations are variable with values of between 2.7 and 3.7% in the zone of the meniscus 19 of the bath of molten metal, where the most intense shrinkage of the skin of the billet 17 occurs due to the onset of cooling, and 0.4–0.8% in the lower part of the crystalliser 16.

According to one characteristic of the invention, the level of the meniscus 19 is constantly controlled and regulated according to the casting speed and the type of steel to be cast, in order to minimise the friction between the skin and the inner wall, and the formation of a gap between the billet 17 cast and the inner wall of the crystalliser 16.

Thanks to the tapered inner configuration of the crystalliser and the regulation of the position of the meniscus 19, it is possible to limit to a minimum the detachment of the billet 17 from the walls 16*a* of the crystalliser 16, since the shrinkage of the billet 17 is compensated by the narrowing in section of the transit channel defined by the crystalliser 16 itself.

This guarantees that optimum conditions of heat exchange are maintained between the walls 16*a* and the billet 17, with a considerable further improvement in the processes of cooling and solidification of the skin 17*a* of the billet 17. Moreover, this ensures a better guide of the billet 17 inside the crystalliser 16, preventing the formation of defects such as the billet 17 assuming a rhomboid shape.

The crystalliser 16 has a cross section which, due to its own geometric characteristics, confers thereon a considerable structural rigidity, considerably limiting the deformability of the walls 16*a* and hence maintaining the tapered inner configuration substantially unchanged. To increase the structural rigidity there are segments of a greater thickness 27 provided for reinforcement purposes and associated with the corners 16*b* of the crystalliser 16 (FIG. 3).

According to a variant, the segments with a greater thickness 27 are defined by autonomous reinforcement inserts coupled with the corners 16*b* of the crystalliser.

The deformability of the walls 16*a* of the crystalliser 16 is further limited by providing a primary cooling system 18 with a high coefficient of heat exchange.

Figure 3:
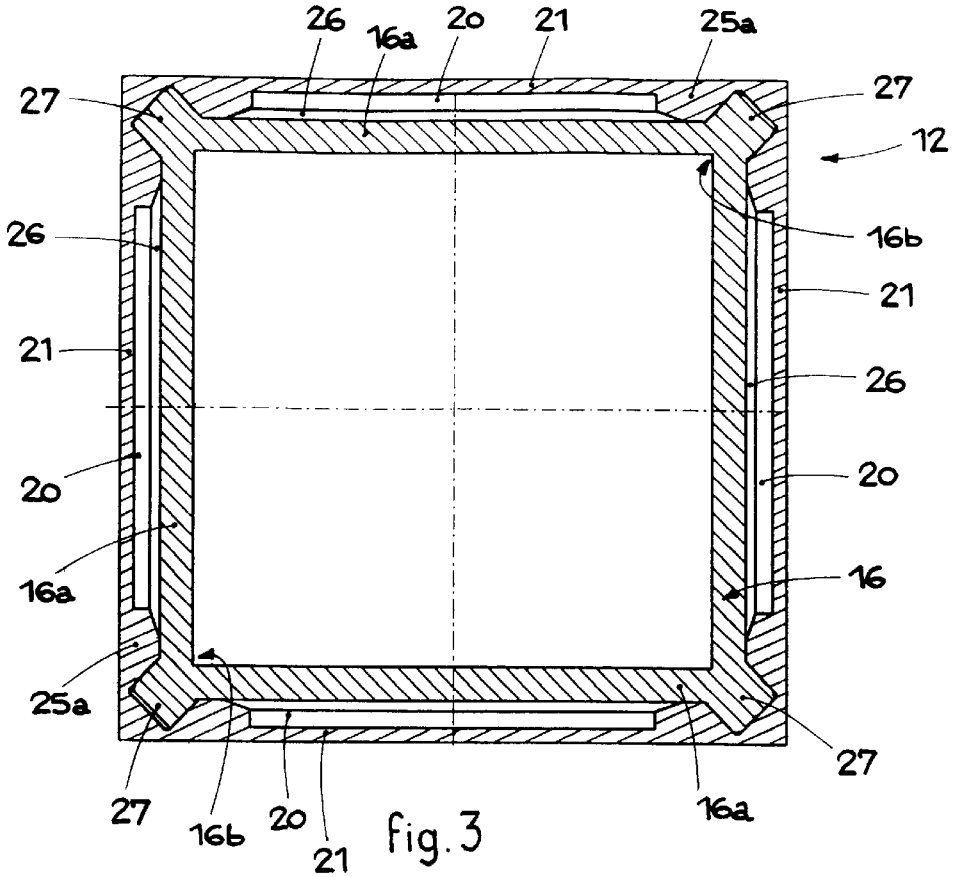
FIG. 3 is a transverse section of a first form of embodiment of the crystalliser of the device according to the invention.

The primary cooling system 18, in the embodiment shown in FIG. 3, comprises chambers 20 for the circulation of the cooling fluid, defined between the walls 16*a* and a containing jacket 21 which develops outside the crystalliser 16, as part of the ingot mold 12.

According to a variant, the circulation chamber 20 includes preferential channels 26 inside which the cooling fluid is forced to pass right up against the walls 16*a* of the crystalliser. Advantageously the preferential channels 26 are between 2.5 mm and 5.5 mm thick.

There may be included turbulence elements, not shown here, suitable to cause a turbulent flow of the cooling fluid inside the channels 26, thus contributing to increase the heat exchange between the parts.

The turbulence elements may consist, for example, of grooves or hollows made on the outer face of the walls of the crystalliser or on the inner face of the containing jacket 21.

Figure 4:
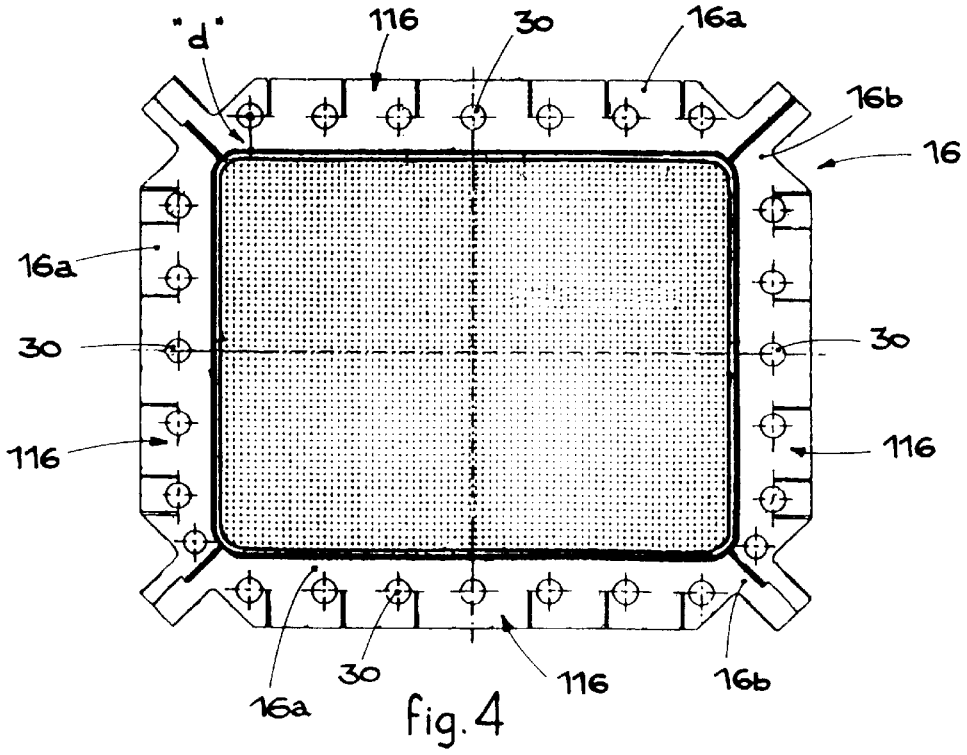
FIG. 4 shows a variant of FIG. 3.

In the embodiment shown in FIG. 4, the cooling system 18 provides a plurality of longitudinal parallel holes 30, circular in section, made in the thickness of each plate 116 of the crystalliser 16, inside which the cooling fluid is made to circulate.

Figure 5A:
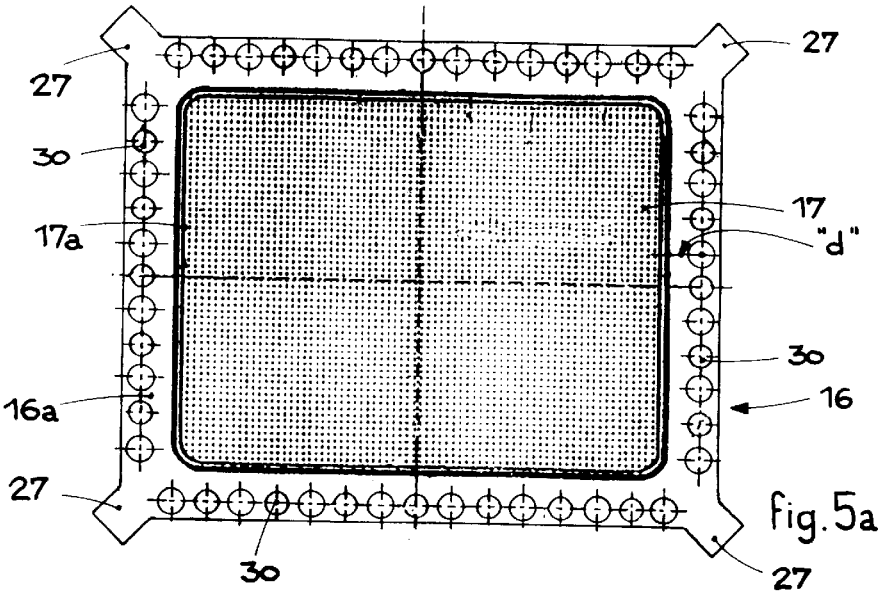
FIG. 5*a* shows a variant of FIG. 4.
Figure 5B:
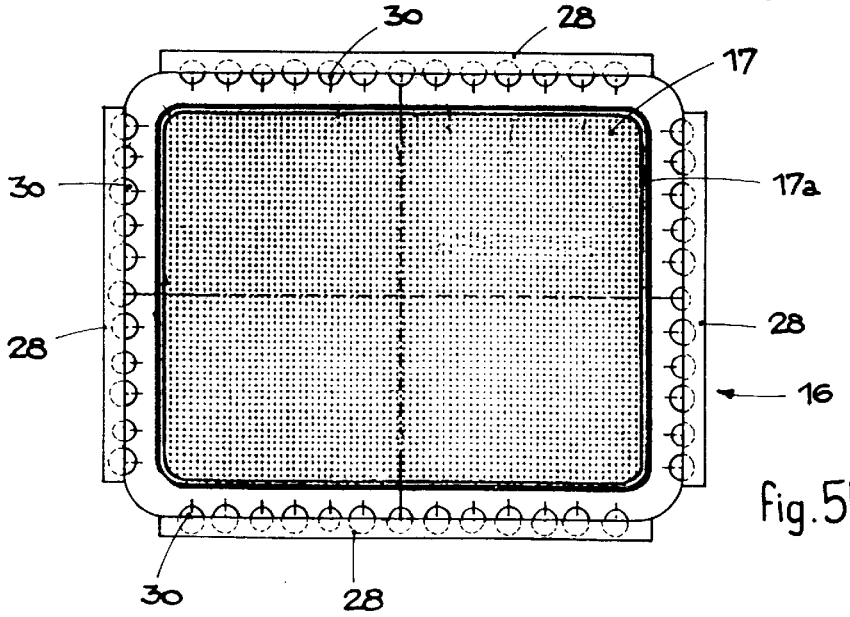
FIG. 5*b* shows a variant of FIG. 5*a;*

The embodiments shown in FIGS. 2 and 5*a* and 5*b*, which refer to tubular crystallisers, also provide that the cooling liquid circulates inside longitudinal holes 30 made in the thickness of the wall 16*a* of the crystalliser 16.

The longitudinal holes 30 have a diameter of between 8 and 16 mm and are arranged at a distance "d", of between 5 and 20 mm, preferably between 7 and 15 mm, from the inner surface of the relative plate 116.

According to a variant, the longitudinal holes 30 have turbulence elements, made on their inner surface, suitable to cause a turbulent circulation of the cooling fluid.

The primary cooling system 18 provides the circulation of the cooling fluid at speeds of between 12 and 28 meters per second, with preferential values of between 15 and 22 meters per second.

The configuration and the working parameters of the primary cooling system 18, particularly the geometry and surface characteristics of the preferential channels 26 and the longitudinal holes 30, and the speed of circulation of the cooling fluid allow to obtain coefficients of heat exchange between the cooling fluid and the walls of the crystalliser of between 120,000 W/mK and 160,000 W/mK.

Moreover, thanks to the holes 30 in the thickness of the wall 16*a* of the crystalliser 16, it is possible to take the cooling liquid nearer to the liquid metal, yet still maintain a good thickness of the crystalliser wall.

This ensures the necessary characteristics of structural rigidity and resistance of the crystalliser 16 even when there are high thermal and mechanical stresses.

In the variant shown in FIG. 5*b*, the longitudinal holes 30 are semicircular, made on the outer face of the wall of the crystalliser 16 and are then closed from the outside by plates 28.

The plates 28 may include, in the variant shown with a line of dashes, semicircular shapings which couple with mating semicircular shapings made on the outer wall of the crystalliser to define circular holes 30 through which the cooling liquid passes.

Figure 6A:
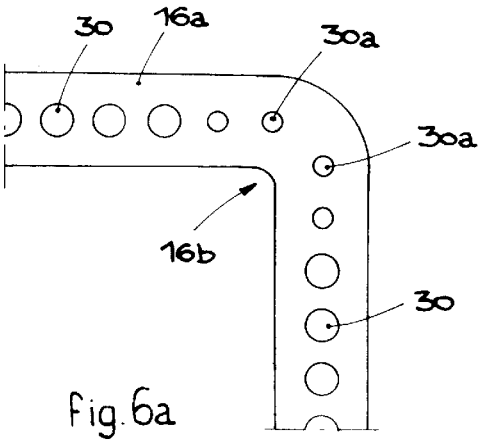
FIGS. 6*a* and 6*b* show two embodiments of the detail of the corner zone of a crystalliser according to the invention.
Figure 6B:
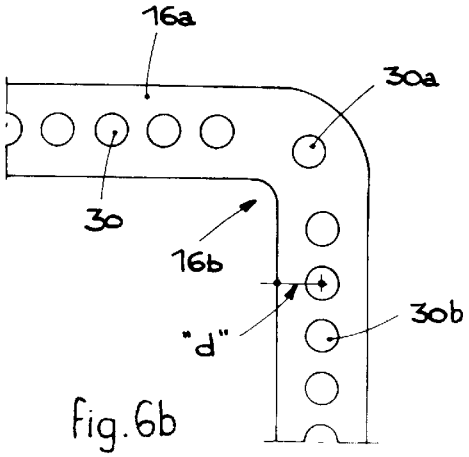

In the embodiments shown in FIGS. 6*a* and 6*b*, the primary cooling system 18 is differentiated in correspondence with the corners 16*b* of the crystalliser 16 with respect to its plane zones.

To be more exact, in the embodiment shown in FIG. 6*a*, the holes 30*a* for the passage of cooling liquid located in correspondence or in proximity with the corner 16*b* are smaller in section than the holes 30 provided along the plane parts of the crystalliser 16.

With this embodiment a lesser volume of the cooling liquid is delivered in correspondence with the corner 16*b* and therefore the capacity to remove heat is reduced; as a consequence the cooling parameters are made uniform with respect to the plane faces of the crystalliser 16.

According to a variant which is not shown here, the holes 30*a* in correspondence with the corner 16*b* are fed with a flow of water which is modulated, in volume or pressure, according to the specific cooling requirements of the corner zone.

According to the further variant shown in FIG. 6*b*, the holes 30*a* in correspondence with the corner 16*b* are less dense than the holes 30*b* on the plane faces of the crystalliser 16.

In the embodiment shown in FIG. 3, the circulation chamber 20 is interrupted in correspondence with the corners 16*b* of the crystalliser 16.

The cooling liquid is fed to the circulation chamber 20, or the longitudinal holes 30, by means of a delivery pipe 22*a* associated with regulation means 23*a*, and a discharge pipe 22*b* associated with regulation means 23*b*.

The regulation means 23*a* and 23*b* allow to modulate the feed of the cooling fluid to the various zones of the crystalliser 16 in a differentiated manner according to the intensity of cooling required.

The continuous casting process using the device 10 as described heretofore provides that, during its passage inside the crystalliser 16, the cast metal can be subjected to the action of a pulsing magnetic field generated from outside.

For this purpose the ingot mold 12 comprises, in a position outside the crystalliser 16 and closed inside a containing structure 29, electromagnetic stirrer means 31 of a known type, suitable to generate a pulsing magnetic field which interacts with the cast metal.

The pulsing magnetic field allows to improve the inner and surface quality of the billet 17 in terms of reducing the friction between the walls of the crystalliser and the billet 17.

This entails an improvement in the inner quality of the billet 17 in terms of segregation index, inner porosity, equiaxial fraction, etc.

The electromagnetic means 31 are suitable to be fed in a differentiated manner to allow a selective modulation of the pulsing magnetic field generated, according to the specific operating conditions and/or the steps of the casting process under way and/or the characteristics of the cast metal.

According to a variant, the electromagnetic means 31 are fed in a differentiated manner along their upward development, to generate magnetic fields with different characteristics according to the conditions of solidification of the cast metal.

According to another variant, the magnetic fields with different characteristics along the crystalliser 16 are generated by arranging at least two electromagnetic means, aligned one below the other, fed in a differentiated manner.

The modulation of the pulsing magnetic field also allows the formation of a micro-interspace between the solidified skin 17*a* of the billet 17 and the walls 16*a* of the crystalliser 16.

This micro-interspace can allow, at least in the zone where the skin first solidifies, to maintain the cooling flow below a certain value in order to limit the formation of surface cracks in that zone.

Moreover, the micro-interspace created by the pulsing magnetic field allows lubricating substances to infiltrate between the billet 17 and the walls of the crystalliser 16, which prevents problems of sticking and friction.

By using this invention it is possible to increase the casting speed by as much as three-four times those normally reached until now by devices known in the state of the art, with a consequent proportionate increase in productivity of the casting machine 11.

The solidification of the billet 17 produced takes place gradually and uniformly and is completed, downstream of the straightening means, when the billet 17 is taken into a substantially horizontal position.

To prevent the formation of cracks inside the billet 17, the guide, containing and possibly pre-rolling assembly 14 and the removal and straightening assembly 15 include equipment configured according to a multi-radius line, with radii of curvature first decreasing from the outlet of the crystalliser 16 to the point of maximum curvature, and then increasing until the straightening of the billet 17.

The radii of curvature are correlated to the radius of curvature "R" of the crystalliser 16, and cause a gradual and progressive deformation of the billet 17 until the final, rectilinear conformation is reached.

This confers on the billets 17 a further improvement in the surface and inner quality, and a considerable uniformity of size and geometry.

It is obvious that modifications and additions may be made to this invention, yet these shall remain within the field and scope thereof.

What is claimed is:

1. A high speed continous casting device for metal products, comprising:

an ingot mold provided with a crystalliser having side-walls between which a molten metal as it cools is suitable to take shape, an assembly, for guiding, containing and optionally pre-rolling, located downstream of said ingot mold, wherein said assembly cooperates with secondary cooling means located in a secondary cooling zone located at the outlet of said crystallizer, and a primary cooling system associated with said side-walls, wherein a lower part of said crystallizer has a longitudinal development comprising a portion at least slightly curved with a radius of curvature ("R") having a value at least five times more than the first radius of curvature of a first segment of said assembly, for guiding, containing and optionally pre-rolling, in the secondary cooling zone located at the outlet of said crystalliser, and wherein the length (L) of said walls is more than 1050 mm, so that a progressive and gradual deformation of the product being formed is obtained which prevents tensions, inner cracks and surface lesions from forming thereon.

2. The device as in claim 1, wherein the crystalliser has a radius of curvature ("R") of about 70 meters.

3. The device as in claim 1, wherein the crystalliser has a substantially vertical longitudinal development.

4. The device as in claim 1, wherein the crystalliser has a substantially tapered longitudinal inner development, with a downward facing taper.

5. The device as in claim 4, wherein said taper is of a continuous type with a substantially parabolic development.

6. The device as in claim 4, wherein said taper is of a discontinuous or segmented type (multi-tapered).

7. The device as in claim 4, wherein the walls of the crystalliser have a taper with values between 2.7 and 3.7% in the zone of the meniscus of the bath of molten metal and between 0.4 and 0.8% in the lower part.

8. The device as in claim 1, wherein the crystalliser is between 1050 and 1500 mm in length.

9. The device as in claim 1, wherein the crystalliser has segments with a greater thickness for greater structural rigidity in correspondence of the corners.

10. The device as in claim 1, wherein said primary cooling system comprises chambers for the circulation of cooling liquid outside the walls of the crystalliser and includes transit channels of between 2.5 and 5.5 mm thick.

11. The device as in claim 1, wherein said primary cooling system comprises holes for the circulation of cooling liquid made in the thickness of the wall at a distance ("d") from the inner face of the wall of the crystalliser, said distance ("d") being between 5 and 20 mm.

12. The device as in claim 11, wherein said holes are circular in section with a diameter between 8 and 16 mm.

13. The device as in claim 11, wherein said holes are made on the outer face of the wall of the crystalliser and are closed by outer closing plates.

14. The device as in claim 10, wherein said preferential transit channels or said holes cooperate with turbulence means suitable to encourage a turbulent circulation of the cooling liquid.

15. The device as in claim 1, wherein electromagnetic means are provided to generate a pulsing magnetic field interacting with the product being formed to encourage the at least partial detachment from the inner wall of the crystalliser and to allow the infiltration of lubrication powders between the product and the wall.

16. The device as in claim 11, wherein said preferential transit channels or said holes cooperate with turbulence means suitable to encourage a turbulent circulation of the cooling liquid.

17. The device as in claim 11, wherein said primary cooling system comprises holes for the circulation of cooling liquid made in the thickness of the wall at a distance ("d") from the inner face of the wall of the crystalliser, said distance ("d") being between 7 and 15 mm.

18. A method of high speed continous casting to produce billets to be sent for rolling comprising:

providing a high speed continous casting device for casting said billet, comprising an ingot mold provided with a crystalliser having side-walls between which a molten metal as it cools is suitable to take shape, an assembly, for guiding, containing and optionally pre-rolling, located downstream of said ingot mold, wherein assembly cooperates with secondary cooling means located in a secondary cooling zone located at the outlet of said crystallizer, and a primary cooling system associated with said side-walls, wherein a lower part of said crystalliser has a longitudinal development comprising a portion at least slightly curved with a radius of curvature ("R") having a value at least five times more than the first radius of curvature of a first segment of said assembly, for guiding, containing and optionally pre-rolling, in the secondary cooling zone located at the outlet of said crystalliser, and wherein the length (L) of said walls is more than 1050 mm, so that a progressive and gradual deformation of said billet being formed is obtained which prevents tensions, inner cracks and surface lesions from forming thereon, progressively cooling said molten metal discharged inside said crystalliser of said ingot mold, said crystalliser being associated with said primary cooling syste, circulating cooling fluid in said primary cooling system, wherein said cooling fluid circulates in channels adjacent to the outer face of the wall of the crystallisers, or in through holes made in the thickness of the walls thereof, at a speed of between 12 and 28 meters per second.

19. The method as in claim 18, wherein a regulation of the parameters of the primary cooling system is provided in such a manner as to obtain a heat exchange between the cooling liquid and the wall of the crystalliser between 120,000 W/mK and 160,000 W/mK.

20. The method as in claim 18, wherein means are provided to differentiate the cooling parameters in correspondence with the corners of the crystalliser.

21. The method as in claim 18, wherein means are provided to subject the liquid metal cast to the action of pulsing magnetic fields as said liquid metal cast passes inside the crystalliser, said magnetic fields being such as to define an interspace between the product being formed and the wall of the crystalliser so that lubricating means can infiltrate.

22. The method as in claim 21, wherein said pulsing magnetic fields have differentiated parameters along the length of the crystalliser.

23. The method as in claim 21, wherein the position of the meniscus is regulated according to the casting parameters and the type of material cast.

24. The method as in claim 19, wherein means are provided to differentiate the cooling parameters in correspondence with the corners of the crystalliser.

25. The method of claim 18, wherein said cooling fluid is able to circulate in channels adjacent to the outer face of the wall of the crystalliser, or in through holes made in the thickness of the walls thereof, at a speed of between 15 and 22 meters per second.

26. A high speed continous casting device for metal products, comprising:

an ingot mold provided with a crystalliser having side-walls, an assembly, for guiding, containing and optionally pre-rolling, wherein said assembly, for guiding, containing and optionally pre-rolling, is located downstream of said ingot mold and has a curved development to bring a casting billet from a substantially vertical casting position to a substantially horizontal position, a secondary cooling means associated with said assembly for guiding, containing and optionally pre-rolling, and a primary cooling system associated with said side-walls, wherein at least a lower part of said crystalliser has a longitudinal development at least slightly curved with a radius curvature ("R") having a value at least five times greater than a radius of curvature of a first segment of the curved development of said assembly, for guiding, containing and optionally pre-rolling, wherein the crystalliser has a length (L) equal to at least 1050 mm, and wherein inner faces of the sidewalls have a converging tapered downward development with a tapering value related to detachment of skin of the product during cooling inside the crystalliser, and wherein the primary cooling system comprises chambers or longitudinal holes for circulation of cooling fluid for heat exchange with the molten metal.

27. The device as in claim 26, wherein the crystalliser has a radius of curvature ("R") of between 60 and 85 meters.

28. The device as in claim 26, wherein said chambers for the circulation of cooling fluid are defined between the outer faces of the side walls and containment cladding outside the crystallizer, the chambers having preferential channels through which the fluid is forced to circulate with a speed of between 12 and 28 meters per second, the channels having a thickness between 2.5 and 5.5 mm.

29. The device as in claim 26, wherein the primary cooling system comprises chambers or longitudinal holes for circulation of cooling fluid at sufficient speed to achieve coefficients of heat exchange between the cooling fluid and the walls of the crystallizer of between 120,000 W/mk and 160,000 W/mK.

* * * * *

UNITED STATES PATENT AND TRADEMARK OFFICE

CERTIFICATE OF CORRECTION

PATENT NO. : 6,315,030 B1
DATED : November 13, 2001
INVENTOR(S) : Alfredo Poloni et al.

It is certified that error appears in the above-identified patent and that said Letters Patent is hereby corrected as shown below:

Title page,
Item [75], Inventor, the third inventor is -- Nuredin KAPAJ of Via Caprera 7, 33100 Udine, Italy --.

Signed and Sealed this

Twenty-eighth Day of September, 2004

JON W. DUDAS
*Director of the United States Patent and Trademark Office*